US009874205B2

(12) United States Patent
Kuny et al.

(10) Patent No.: US 9,874,205 B2
(45) Date of Patent: Jan. 23, 2018

(54) VACUUM PUMP HAVING AN ADJUSTABLE HOUSING

(71) Applicant: GARDNER DENVER SCHOPFHEIM GMBH, Schopfheim (DE)

(72) Inventors: Markus Ernst Kuny, Rheinfelden (DE); Wolfgang Jürgen Gorzawski, Maulburg (DE); Friedrich Justen, Lörrach (DE); Ronald Sachs, Schopfhelm (DE)

(73) Assignee: GARDNER DENVER SCHOPFHEIM GMBH, Schopfheim (DE)

( * ) Notice: Subject to any disclaimer, the term of this patent is extended or adjusted under 35 U.S.C. 154(b) by 498 days.

(21) Appl. No.: 14/357,171

(22) PCT Filed: Dec. 7, 2012

(86) PCT No.: PCT/EP2012/074853

§ 371 (c)(1),
(2) Date: May 8, 2014

(87) PCT Pub. No.: WO2013/083808

PCT Pub. Date: Jun. 13, 2013

(65) Prior Publication Data

US 2014/0363317 A1 Dec. 11, 2014

(30) Foreign Application Priority Data

Dec. 9, 2011 (DE) ..... 20 2011 108 871 U

(51) Int. Cl.
*F04B 35/04* (2006.01)
*F04C 11/00* (2006.01)
(Continued)

(52) U.S. Cl.
CPC ..... *F04B 35/04* (2013.01); *F04B 39/06* (2013.01); *F04B 53/08* (2013.01); *F04B 53/16* (2013.01);
(Continued)

(58) Field of Classification Search
CPC ..... F04B 35/04; F04B 53/16; F04B 53/08; F04B 39/06; F04C 2240/30; F04C 2240/70; Y10T 403/5761–403/5786
(Continued)

(56) References Cited

U.S. PATENT DOCUMENTS 3,076,414 A 2/1963 Adams
3,333,544 A * 8/1967 Turk ..... F04D 13/0606 310/86

(Continued)

FOREIGN PATENT DOCUMENTS

DE 103 44 719 A1 5/2005
EP 0 509 724 A1 10/1992
EP 1 211 784 A1 6/2002

OTHER PUBLICATIONS

International Search Report regarding parent case PCT/EP2012/074853, dated May 14, 2013 (7 pages).

(Continued)

*Primary Examiner* — Essama Omgba
*Assistant Examiner* — Stephen Mick
(74) *Attorney, Agent, or Firm* — Michael Best & Friedrich LLP

(57) ABSTRACT

The invention relates to a pump. The pump has a pump housing comprising a first and second housing part (1, 2). The first housing part (1) has a first fluid port (10) and a first face side (8). The second housing part (2) has a second fluid port (27) and a second face side (9). The second housing part is axially connectable with the first housing part (1). Further, (Continued)

the pump has a pump motor in the first housing part (1) and a fluid mover in the second housing part (2). The fluid mover is drivable by the pump motor. Further, the pump has a housing part connecting device (3) for axially connecting the first housing part (1) and the second housing part (2) with each other. The housing part connecting device (3) is adjustable between a connecting and a release position. In the connecting position, the first housing part (1) and the second housing part (2) are fixed in an axial and rotary manner with each other. In the release position, the first housing part (1) and the second housing part (2) are pivotable relative to each other and are fixed in an axial manner with each other.

16 Claims, 4 Drawing Sheets

(51) Int. Cl.
*F04B 39/06* (2006.01)
*F04B 53/08* (2006.01)
*F04B 53/16* (2006.01)

(52) U.S. Cl.
CPC ..... *F04C 11/008* (2013.01); *F04C 2240/30* (2013.01); *F04C 2240/70* (2013.01)

(58) Field of Classification Search
USPC ..... 417/360, 371, 410.3
See application file for complete search history.

(56) References Cited

U.S. PATENT DOCUMENTS

| | | | | |
|---|---|---|---|---|
| 3,572,982 | A | 3/1971 | Kozdon | |
| 3,826,589 | A | 7/1974 | Frank et al. | |
| 4,773,823 | A | 9/1988 | Pease | |
| 5,129,795 | A | 7/1992 | Hyland | |
| 5,496,155 | A | 3/1996 | Noah et al. | |
| 6,554,565 | B2 | 4/2003 | Suzuki et al. | |
| 7,531,092 | B2 | 5/2009 | Hazelhurst | |
| 2003/0194331 | A1* | 10/2003 | Pitla | F04B 39/121 417/360 |
| 2005/0158195 | A1 | 7/2005 | Peterson, Jr. et al. | |
| 2010/0171303 | A1* | 7/2010 | Krausz | F24F 13/0209 285/184 |
| 2012/0251357 | A1* | 10/2012 | Yokoi | B60H 1/00514 417/410.1 |
| 2012/0308414 | A1* | 12/2012 | Ogawa | F04B 39/06 417/410.5 |

OTHER PUBLICATIONS

Written Opinion of International Searching Authority regarding parent PCT case PCT/EP2012/074853, dated May 14, 2013(11 pages).
International Preliminary Report on Patentability regarding parent PCT case PCT/EP2012/074853, dated Jan. 22, 2014, (30 pages), Article 34 Amendments included.
German Search Report regarding priority case DE 20 2011 108 871.9 with English summary, dated Sep. 13, 2012 (5 pages).

* cited by examiner

VACUUM PUMP HAVING AN ADJUSTABLE HOUSING

The invention relates to a pump, in particular to a vacuum pump and/or a compressor, for transporting and/or compressing a fluid. Fluid can be gas or ambient air. In the case of a pump which does not compress the fluid the fluid can also be liquid.

Pumps for transporting fluids and compressing fluids are well known in the prior art. Many pumps are not adjustable to their installation environment. The installation of these pumps is often difficult and time-consuming. The installation of these pumps is often difficult and time-consuming. It is furthermore disadvantageous that their components are not sufficiently cooled.

U.S. Pat. No. 7,531,092 discloses a liquid pump for use with a circulation system for a recreational body of water. The liquid pump includes a strainer housing, a pump housing assembly secured to the strainer housing, and a lock ring fastened to the pump housing assembly. The pump housing assembly includes an outlet that is rotatable between a first position and a second position.

U.S. Pat. No. 5,496,155 discloses a pump that includes a housing. The housing has a main section and a cover section. The main section of the housing has three separate risers. Any one of the risers may be connected with a fluid conduit. The main and cover sections of the housing are moveable relative to each other to enable the rotary device to be mounted in a selected one of a plurality of positions.

U.S. Pat. No. 3,076,414 discloses a pump that has a housing and an end cap or block which telescopes into the housing. The end cap is secured with screws to the housing. The end cap may be rotated in any one of four positions relative to the housing. By this arrangement the relative position of the inlet in the housing and the outlet in the cap may be changed relative to one another.

In one embodiment of the invention a pump is provided which includes a housing part connecting device. In the connecting position, the housing part connecting device, couples a first housing part to a second housing part so the first housing part and second housing part are fixed in an axial and rotary manner with each other. Consequently, in the connecting position, the housing part connecting device prevents an axial and rotary movement between the first housing part and the second housing part. In a release position, the connecting device is still coupled to the first housing part and the second housing part. The housing parts are, however, pivotable relative to each other and are limited in an axial manner with each other. Consequently, in the release position, the housing part connecting device enables a pivotal relative movement between the first housing part and the second housing part. Thus, the first fluid port and/or the second fluid port is adjustable to its installation environment, in particular to a fluid conduit. Further, in the release position, the housing part connecting device prevents or limits an axial movement between the first housing part and the second housing part.

It is advantageous when the first housing part and the second housing part are skewed towards each other by 360°. The terms "axial", "axially", "radial" and "radially" used in this disclosure are in relation to a longitudinal central axis of the first housing part and/or the second housing part.

In a further embodiment of the invention the pump motor is an electric motor.

The fluid movement device for the fluid transport is a pump wheel, a rotor, a membrane, a piston device or a rotary slide device. Other fluid movement devices are applicable, alternatively.

In an embodiment of the invention the first fluid port is radially positioned at the first housing part. The first fluid port radially project from the first housing part. The, the first fluid port is a fluid inlet.

In still a further embodiment the second fluid port is radially positioned at the second housing part. The second fluid port radially projects from the second housing part. The second fluid port is a fluid outlet.

Preferably, the first fluid opening is annular at the first face side and fully extends at the first face side around the first central longitudinal axis. Preferably, the first fluid opening is axially open towards the second housing part.

Preferably, the second fluid opening is annular at the second face side and fully extends at the second face side around the second central longitudinal axis. Preferably, the second fluid opening is axially open towards the first housing part. Preferably, the first fluid opening and the second fluid opening have at the face sides of the pump housing an identical design and an identical distance to their central longitudinal axis. Preferably, the central longitudinal axes are aligned to each other.

The common fluid overlap enables a fluid connection between the first housing part and the second housing part.

In a further embodiment, the first housing part and the second housing part have peripheral connection protrusions. Particularly, the peripheral connection protrusions have an annular design and completely extend around the respective central longitudinal axis at the respective housing part.

Preferably, the connecting ring forms a sealing.

Preferably, the connecting ring adjustment member enables an adjustment of the effective length or diameter of the connecting ring. Preferably, the connecting ring adjustment member comprises a bolt which is manually adjustable and causes an adjustment of the length or diameter of the connecting ring by operation. Preferably, the bolt has a bolt thread and penetrates two mounting members fastened in end regions of the connecting ring to the connecting ring. Preferably, the first mounting member forms an abutment for the head of the bolt, while the second mounting member has a thread engaged by the bolt thread.

The outer wall of the connecting ring may have different designs. The side walls of the connecting ring may extend parallel or inclined to each other. The receiving chamber of the connecting ring may be engaged by the peripheral connection protrusions.

According to another embodiment, in the vicinity of the pump motor, there is at least one first fluid receiving space for cooling the pump motor. Preferably, the fluid receiving space is spatially limited by the pump housing. Hereby, heat originating from the operation of the pump motor is particularly effectively dischargeable from the pump motor by the fluid contained in the first fluid receiving space.

According to another embodiment, in the vicinity of the electric control unit, there is at least one second fluid receiving space. Thus, heat originating from the operation of the electronic control unit is particularly effectively dischargeable from the control unit by fluid flowing through the at least second fluid receiving space.

A preferred embodiment of the invention is described hereinafter with reference to the drawings. This description is to be considered purely exemplary.

Figure 1:
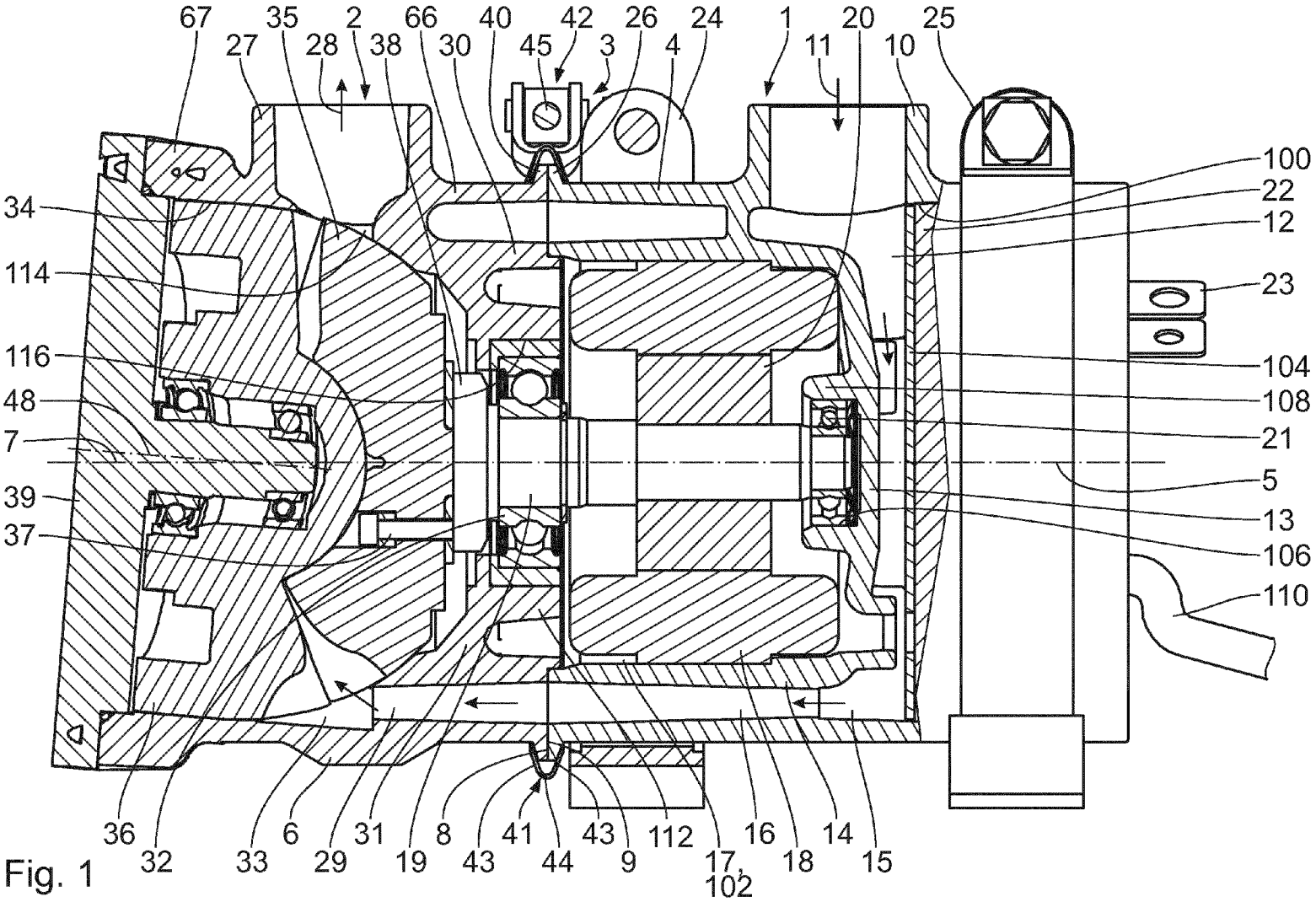
FIG. 1 shows a longitudinal section of a pump embodying the invention.
Figure 2:
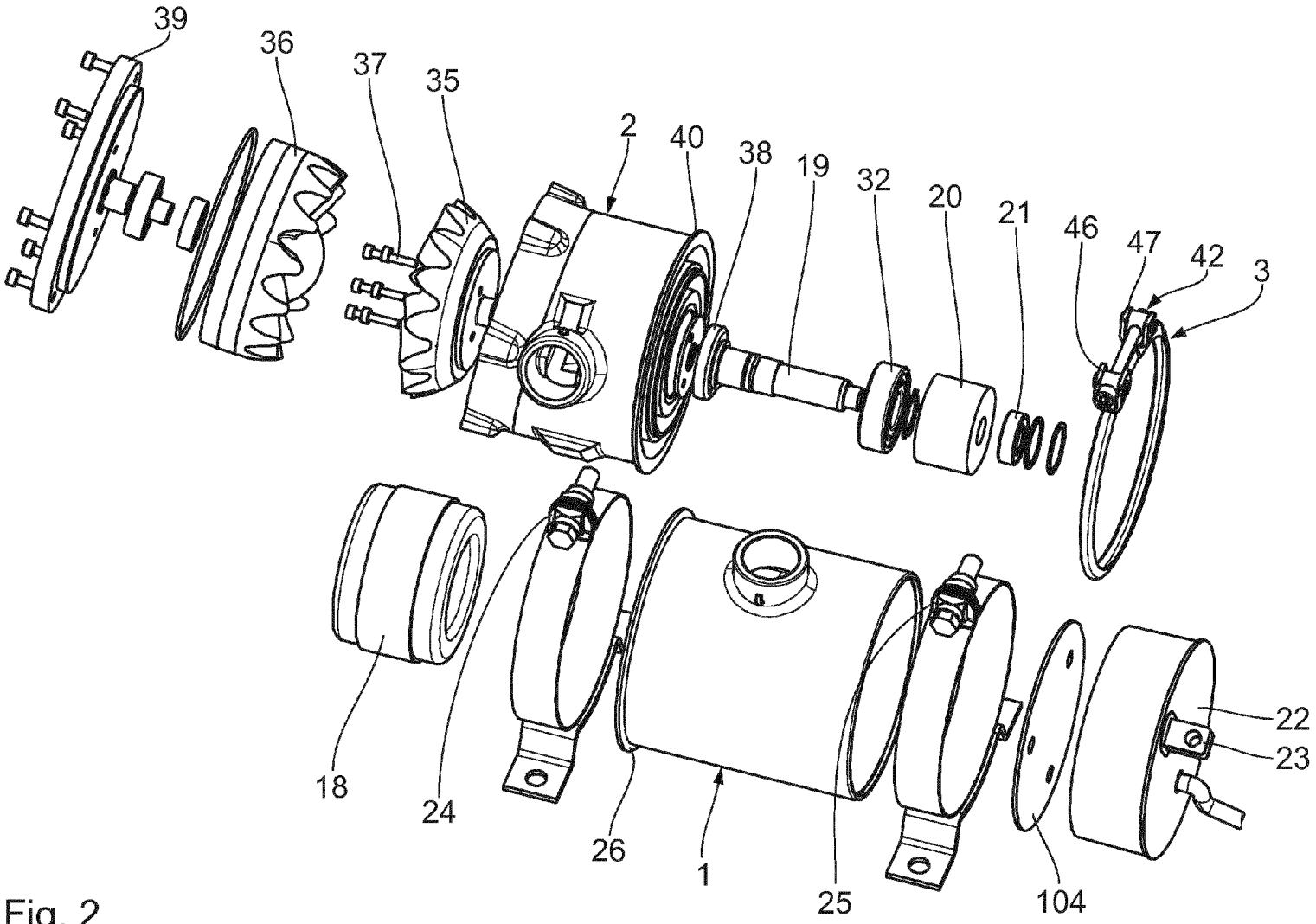
FIG. 2 shows an exploded view of the pump illustrated in FIG. 1.
Figure 3:
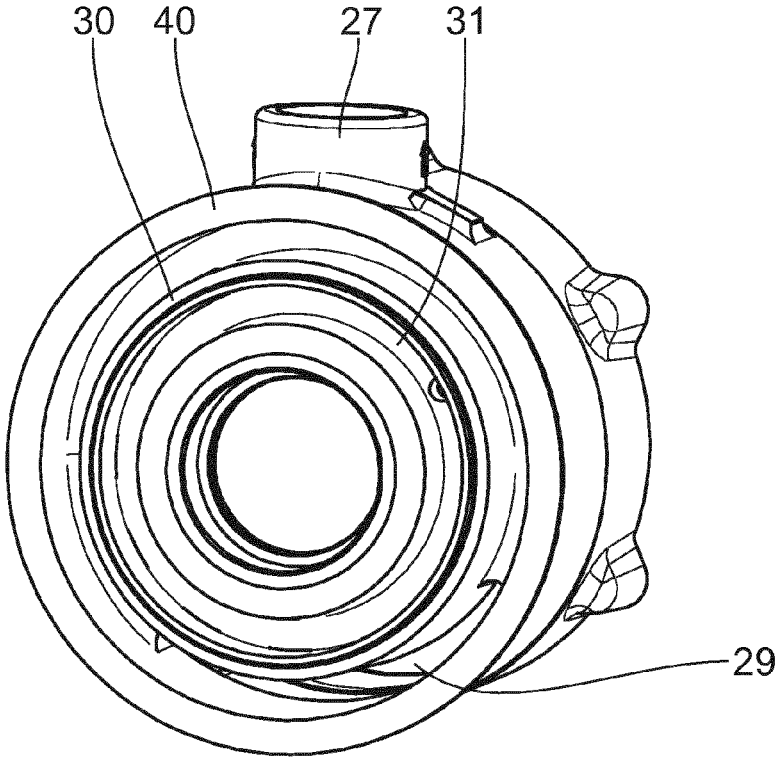
FIG. 3 shows a side view of the second housing part from the first housing part side of the pump shown in FIGS. 1 and 2.
Figure 4:
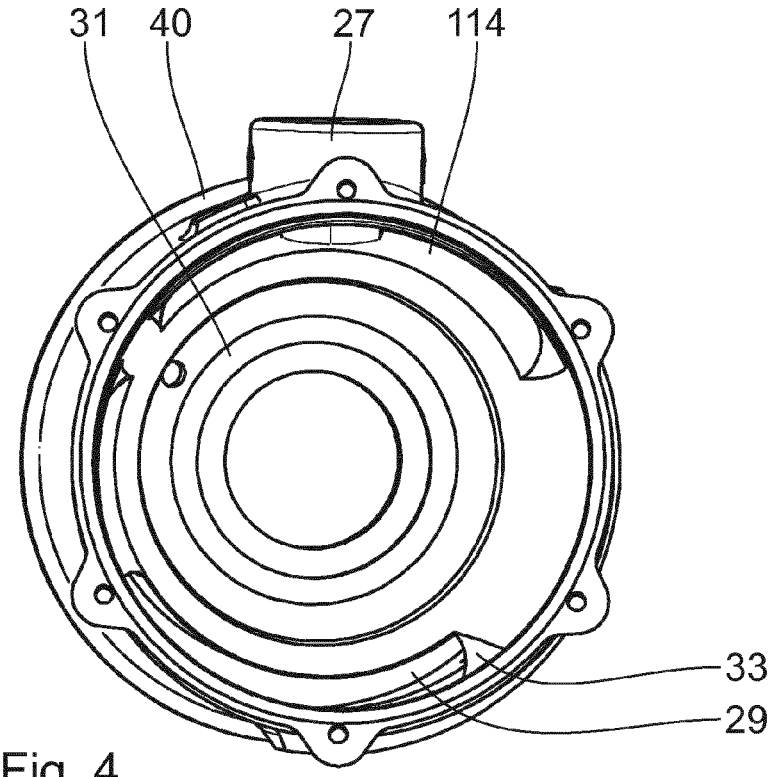
FIG. 4 shows a side view of the second housing part from the other side of the pump shown in FIGS. 1 and 2.
Figure 5:
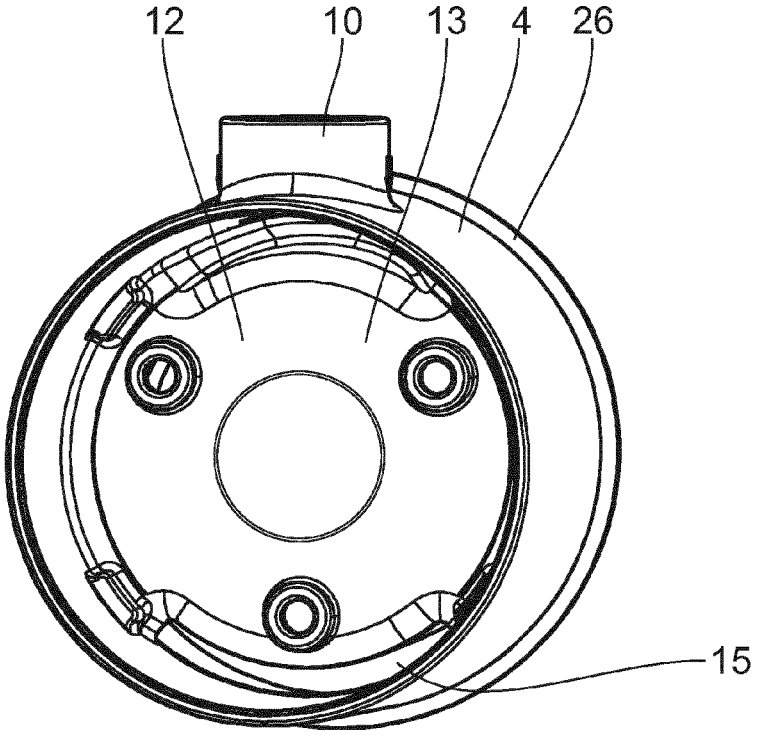
FIG. 5 shows a side view of the first housing part from the second housing part side of the pump shown in FIGS. 1 and 2.
Figure 6:
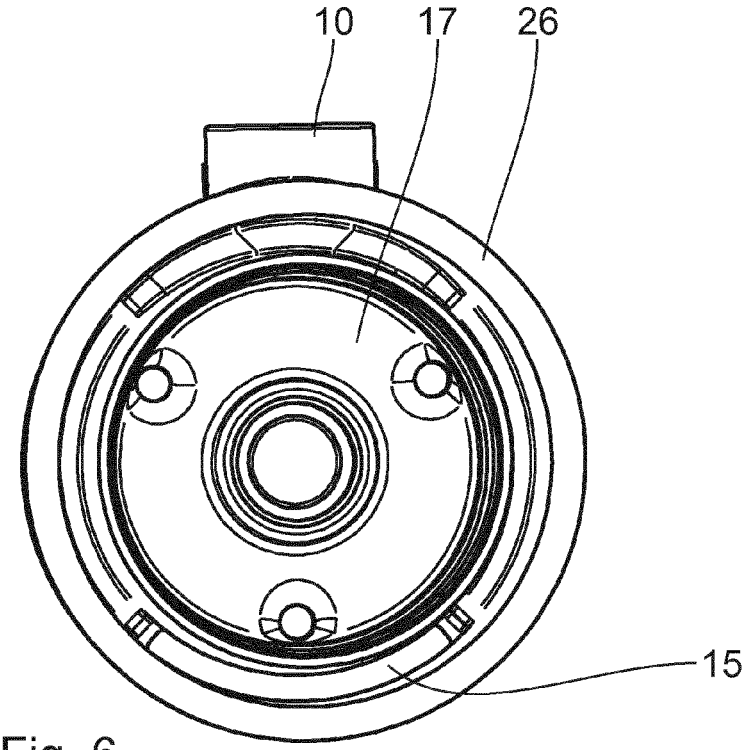
FIG. 6 shows a side view of the first housing part from the other side of the pump shown in FIGS. 1 and 2.

A fluid machine, in particular a pump or a compressor shown in FIGS. 1 and 2 comprises a first housing part 1 and a second housing part 2 which is axially fastened with the first housing part 1 via a housing part connecting device 3. The housing part connecting device 3 can be a band clamp. The first housing part 1 has a first outer wall 4 and a first central longitudinal axis 5. The first outer wall is annular relative to the first central longitudinal axis 5. The second housing part 2 has a second outer wall 6 and a second central longitudinal axis 7. Only a portion 66 of the second outer wall 6 is annular relative to the second central longitudinal axis 7. Another portion 67 is askew relative to the second central longitudinal axis 7. Portion 67 is, however, annular relative to rotor axis 37. The first central longitudinal axis 5 and the second central longitudinal axis 7 are aligned to each other.

Further, the first housing part 1 has a first face side 8, while the second housing part 2 has a second face side 9. The face sides 8, 9 face and abut each other. At the face sides 8, 9, the first outer wall 4 and the second outer wall 6 have the same outer diameter. As shown they have an identical design and size.

The first housing part 1 has a fluid inlet 10 which radially projects from the first outer wall 4. Fluid enters into the first housing part 1 via the fluid inlet 10 which is represented by the arrow 11. The fluid shown in this embodiment is a compressible fluid which is ambient air.

Downstream of the fluid inlet 10, there is a fluid receiving space 12 in the first housing part 1. The fluid receiving space 12 is axially limited towards the second housing part 2 by a first side wall 13 extending in a manner which intersects the first central longitudinal axis 5.

A first inner wall 14 having an annular cross-section projects from the first side wall 13 towards the second housing part 2. Essentially, the first inner wall 14 and the first outer wall 4 are concentrically positioned around the first central longitudinal axis 5.

In the first side wall 13, there is a first fluid aperture 15 which curvedly extends partially around the first central longitudinal axis 5 and is positioned in a radial outer region of the first side wall 13.

The first side wall 13 in part serves to divide the first housing part 1 into a first chamber 100 which houses an electrical assembly 22 and a second chamber 102 which serves to house the pump's motor. The electrical assembly 22 is fixed to a connector plate 104. The connector plate 104 is mounted to the side wall 13 and is held in chamber 100.

Downstream of the first fluid aperture 15, there is a first fluid connection space 16 which has an annular cross-section. The first connecting space 16 is radially limited by the first outer wall 4 and the first inner wall 14. At the first face side 8, the first connecting space 16 is open by forming a first annular fluid opening.

The first inner wall 14 radially limits a pump motor space 17. In the pump motor space 17, a cylindrical stator 18 is positioned. A central shaft 19 projects into the stator 18. The stator 18 and the rotor 20 form an electric motor which is able to rotate the central shaft 19 around its longitudinal axis which is aligned to the first central longitudinal axis 5 of the first housing part 1. The central shaft 19 is supported in a first ball bearing assembly 21. The first side wall 13 carries the first ball bearing 21. The first ball bearing 21 is held in a chamber 106 limited by an annular wall 108 extending axially away from the first side wall 13 and towards first face side 8.

In chamber 100 of first housing part 1 is the electrical assembly 22. The electrical assembly 22 includes ordinary electrical components for operating the electric motor. Preferably, the electrical components are encased in resin to preserve and protect the electrical components. The electrical assembly 22 includes an electrical connector 23 for power which may extend axially outwards the electrical assembly 22 may also include a cable 110 to provide feedback to and from a controller.

A first mounting device 24 surrounds the first outer wall 4 proximate chamber 102 and the motor. A second mounting device 25 surrounds an outer wall proximate the electrical component assembly 22. The mounting devices 24, 25 enable a mounting of the pump to its installation environment. The mounting devices 24 and 25 are flexible straps with a tightening screw joining each end of the strap at one circumferential position. The straps include feet radially opposite the tightening screw. An operator can loosen one or both of the straps around the housing parts 1 and 2 by adjusting the tightening screws. The straps allow an operator to adjust housing parts 1 and 2 without completely removing the straps from housing parts 1 and 2 or removing the straps from the member to which the feet are mounted.

A first peripheral connection ring 26 radially projects from the first housing part 1 adjacent to the first face side 8. The first peripheral connection ring 26 fully extends around the first central longitudinal axis 5. The first peripheral connection ring 26 can be a flange of the first housing part 1.

A fluid outlet 27 radially projects from the second outer wall 6. The fluid outlet 27 is in flow connection with the fluid inlet 10. Put another way fluid outlet 27 is in fluid communication with the fluid inlet 10. As used herein fluid connection and fluid communication can be used interchangeably Fluid may leave the pump via the fluid outlet 27 which is represented by the arrow 28.

The second housing part 2 has a second fluid connecting space 29 which is open towards the first housing part 1. The fluid connecting space 29 forms a second annular fluid opening which opens into the first annular opening of the first housing part 1. The second fluid connecting space 29 has an annular cross-section. The first fluid opening is in flow connection or communication with the second annular fluid opening. They have about the same diameter. They are shown as having an identical design and size.

The second fluid connecting space 29 is radially limited by a second inner wall 30 which has an annular design and extends around the second central longitudinal axis 7. It is also radially limited by portion 66 of the second outer wall 6. The second fluid connecting space 29 is thus radially between the second inner wall 30 and the portion 66 of the second outer wall 6 and extends circumferentially around the second central longitudinal axis 7. The second inner wall 30 and the portion 66 of the second outer wall 6 are concentric. An annular end of the first inner wall 14 is coupled to an annular end of the second inner wall 30. The end of the first inner wall 14 extends around a flange at the annular end of the second inner wall 30.

Further, the second housing part 2 has a second side wall 31 intersecting the second central longitudinal axis 7. The second side wall 31 carries a second ball bearing assembly 32. The second bearing assembly 32 is held in a chamber 116 limited by an annular wall 112 extending axially away from the second side wall 31 and towards the second face side 9. The second bearing assembly 32 supports the central shaft 19. The central shaft 19 penetrates the second side wall 31.

In a radial outer region of the second side wall 31, there is a second fluid aperture 33 which curvedly extends partially around the second central longitudinal axis 7 and provides a fluid connection between the second fluid connecting space 29 and a rotor space 34. The rotor space 34 can also be called a working chamber. The rotor space 34 is positioned in the second housing part 2 and is radially limited by the second outer wall 6. The rotor space 34 is axially limited by the second side wall 31 at one axial end and the cover 39 at another opposite axial end. On a first side of the second side wall 31 is the rotor space 34. The second ball bearing assembly 32 is arranged on an opposite side of the second side wall 31. Looking towards the second side wall 31 through the fluid connecting space 29, the second side wall 31 appears generally concave in a stepped manner towards the center. Looking towards the second side wall 31 from the side which holds the bearing, the second side wall 31 appears convex in a stepped manner. The rotor space 34 is in fluid connection with the fluid outlet 27.

A rotor is arranged in the rotor space 34. The rotor is designed as a core rotor. The rotor comprises a first rotor component 35 connected with the central shaft 19. Further, the rotor comprises a second rotor component 36 connected with the first rotor component 35.

The first rotor component 35 is drivable by the central shaft 19. The first rotor component 35 is coupled directly to the central shaft 19 by fastening bolts 37 that extend axially through the first rotor component 35 into a mounting flange 38 of the central shaft 19.

The second rotor component 36 is drivable by the first rotor component 35. The first rotor component 35 has teeth which interface with teeth of the second rotor component 36.

The second rotor component 36 has an axis of rotation 48 that is askew to the first and second central longitudinal axis 5, 7. Due to the non-alignment of the axes of the rotor components 35, 36, the teeth of the second rotor component 36 are drivable by the teeth of the first rotor component 35, but only at some fraction of the 360°. Typically, that fraction is less than 180°. This relative angle causes the rotor components 35, 36 to be open from each other at the leading edge of opening 33 to capture the fluid passing through opening 33 from the second fluid connecting space 29. The rotor is open where the teeth do not fully intersect. As the teeth close the fluid is compressed and ejected through a channel 114 and out the fluid outlet 27.

An end cover 39 closes the axial end of the pump, opposite the electrical component assembly 22. A second peripheral connection ring 40 radially projects from the second outer wall 6 adjacent to the second face side 9. The second peripheral connection ring 40 fully extends around the second central longitudinal axis 7. The second peripheral connection ring 40 can be considered a flange of the second outer wall 6.

The housing part connecting device 3 has a connecting ring 41 and a connecting ring adjustment member 42. The connecting ring 41 has a cross-section which is designed as a V. Consequently, the connecting ring 41 has two side walls 43 facing each other and connected by an outer wall 44. The side walls 43 and the outer wall 44 define a receiving chamber. The peripheral connection rings 26, 40 protrude into the receiving chamber which is open towards the first housing part 1 and the second housing part 2.

The connecting ring adjustment member 42 comprises a bolt 45 which is manually operable and has an outer bolt thread. The bolt 45 penetrates two mounting blocks 46, 47 fixed at end regions to the connecting ring 41. Essentially, the bolt 45 forms a passant related to the connecting ring 41. The first mounting block 46 forms an abutment for the head of the bolt 45, while the second mounting block 47 has an inner thread engaged by the bolt thread. By operating the bolt 45, the bolt thread turns in the thread of the second mounting block 47 or out of the same, whereby the distance of the mounting blocks 46, 47 is changed. Thereby, the effective length or the diameter of the connecting ring 41 is adjusted.

The housing part connecting device 3 forms a clamp which is adjustable between a connecting position and a release position. In the connecting position, the connecting ring 41 has a reduced length or diameter. The side walls 43 laterally contact the peripheral connection rings 46, 40 and axially press the same together, so that the first housing part 1 and the second housing part 2 are fixed in an axial and rotatably fixed manner with each other.

In the release position, the connecting ring 41 is widened. The side walls 43 loosely contact laterally the peripheral connection rings 26, 40, so that the housing parts 1, 2 are rotatable pivotably relative to each other and the fluid inlet 10 and/or the fluid outlet 27 are adjustable relative to each other. Therefor as made clear above and in the drawings, the fluid inlet and outlet may be fixed in different relative to each other. The side walls 43 limit an axial movement of the housing parts 1, 2 to each other.

Adjustment of the second housing part 2 relative to the first housing part 1 causes the second rotor component 36 to move relative to the first rotor component 35. The movement causes the movement of the air receiving space between the rotor components 35, 36 which carries fluid from aperture 33. The air receiving space moves with space 33 such that the air receiving space between the rotor components 35, 36 always remains aligned with aperture 33.

As already mentioned, the fluid enters via the fluid inlet 10 in the direction of the arrow 11 into the fluid receiving space 12. The electronic assembly 22 is cooled between the fluid receiving space 12 and the first fluid aperture 15 via the connector plate 104. The fluid penetrates the first fluid aperture 15 and flows in and through the first connecting space 16. As the first fluid connecting space 16 axially surrounds the electric motor the electric motor is cooled by the fluid, passing through the first fluid connecting space 16. The electric motor is cooled before the fluid is compressed. From first fluid connecting space 16, the fluid enters into the second fluid space 29 and penetrates the second fluid aperture 33. From the second fluid aperture 33, the fluid enters into the rotor space 34. The fluid is moved by the rotor, which ejects the fluids through the fluid outlet 27 in the direction of the arrow 28. The electric motor is controlled by the electric components. The rotor is driven by the electric motor.

The rotor components 35, 36 in this shown embodiment are a type of fluid mover adapted to compress fluid and transport fluid. The rotor components 35, 36 shown are thus only for a compressible fluid. The rotor components 35, 36 transport a working gas which may be ambient air.

The construction of the pump allows an operator to infinitely adjust the position of the first housing part while the second housing part 2 is held stationary, infinitely adjust the second housing part while the first housing part 1 is held stationary, or a combination thereof.

What is claimed is:

1. A pump for compressing and/or transporting a fluid, the pump having a) a pump housing, comprising i) a first housing part (1), having a first outer wall (4) annular relative to a first central longitudinal axis, a first fluid port (10) in the first outer wall (4) oriented perpendicularly to the first central longitudinal axis, and a first face side (8), and ii) a second housing part (2), having a second outer wall (6) including a first portion being annular relative to a second central longitudinal axis, a second fluid port (27) in the second outer wall (6) oriented perpendicularly to the second central longitudinal axis, wherein the second fluid port (27) is in flow connection with the first fluid port (10), and a second face side (9), b) a pump motor, i) which is arranged in the first housing part (1), c) a fluid mover for transporting the fluid, wherein the fluid mover is i) drivable by the pump motor, and ii) in the second housing part (2), and d) a housing part connecting device (3) for connecting the first housing part (1) and the second housing part (2) with each other, so that the first face side (8) and the second face side (9) face each other, wherein the housing part connecting device (3) is adjustable between a connecting position and a release position, wherein i) in the connecting position, the first housing part (1) and the second housing part (2) are fixed in an axial manner with each other, and fixed in a rotatably fixed manner with each other, and ii) in the release position, the first housing part (1) and the second housing part (2) are rotatable pivotably relative to each other and the first fluid port (10) and the second fluid port (27) are adjustable relative to each other, and limited in relative axial movement to each other.

2. The Pump according to claim 1, characterized in that a second portion of said outer wall (6) is askew relative to the second longitudinal axis (7) and is annular to a rotor axis (48), said first and second central longitudinal axes (5, 7) are aligned, and said fluid mover is a rotor driven by a central shaft (19), said fluid mover comprising i) a first rotor component (35), and ii) a second rotor component (36) drivable by the first rotor component (35), wherein said second rotor component (36) has an axis of rotation (48) that is askew to said first and second central longitudinal axes (5, 7).

3. The Pump according to claim 2, characterized in that the first rotor component (35) has teeth which interface with teeth of the second rotor component (36).

4. The Pump according to claim 1, characterized in that the first housing part (1) has a first central longitudinal axis (5), wherein a first fluid connecting space (16) extending in the first housing part (1) and being in flow connection with the first fluid port (10) has at the first face side (8) a first fluid opening curvedly extending around the first central longitudinal axis (5).

5. The Pump according to claim 4, characterized in that the first fluid opening and the second fluid opening have a common fluid overlap in a first pivotal positions of the first housing part (1) relative to the second housing part (2) and in a second pivotal position of the first housing part relative to the second housing part.

6. The Pump according to claim 1, characterized in that the second housing part (2) has a second central longitudinal axis (7), wherein a second fluid connecting space (29) extending in the second housing part (2) and being in flow connection with the second fluid port (27) has at least at the second face side (9) a second fluid opening curvedly extending around the second central longitudinal axis (7).

7. The Pump according to claim 1, characterized in that the first housing part (1) has at least a first peripheral connection protrusion (26) in the region of the first face side (8) and the second housing part (2) has at least a second peripheral connection protrusion (40) in the region of the second face side (9), wherein the at least one first peripheral connection protrusion (26) and the at least one second peripheral connection protrusion (40) are positioned adjacent to each other.

8. The Pump according to claim 7, characterized in that the at least one peripheral connection protrusion (26) and the at least one second peripheral connection protrusion (40) radially protrude into the peripheral connection protrusion receiving chamber.

9. The Pump according to claim 1, characterized in that the housing part connecting device (3) comprises a connecting ring (41) having an effective length and covering the first housing part (1) and the second housing part (2) in the regions of the first face side (8) and the second face side (9).

10. The Pump according to claim 9, characterized in that the housing part connecting device (3) comprises a connecting ring adjustment member (42) for adjusting the effective length or diameter of the connecting ring (41).

11. The Pump according to claim 9, characterized in that the connecting ring (41) limits a peripheral connection protrusion receiving chamber which is radially open towards the first housing part (1) and the second housing part (2).

12. The Pump according to claim 11, characterized in that the peripheral connection protrusion receiving chamber is outwards radially limited by an outer wall (44).

13. The Pump according to claim 1, characterized in that a fluid receiving space (16) for cooling the pump motor runs adjacent to the pump motor in the first housing part (1), wherein an inner wall (14) of the first housing part (1) radially limits the fluid receiving space (16) and the pump motor space (17) in which the pump motor is arranged.

14. The Pump according to claim 1, characterized in that, in the first housing part (1), a fluid receiving space (12) for cooling the electrical assembly (22) runs adjacent to an electrical assembly (22) for controlling the pump motor, wherein the electrical assembly (22), on the face side, is arranged opposite to the first face side (8) on the first housing part (1).

15. The Pump according to claim 1, the pump further having e) at least one fluid receiving space (16) in the first housing part (1) for cooling the pump motor using the fluid flowing from the first fluid port (10) to the second fluid port (27), i) wherein the at least one fluid receiving space (16) runs adjacent to the pump motor in the pump housing, ii) wherein, the at least one fluid receiving space (16) is spatially limited by an inner wall (14) of the first housing part (1) and the first outer wall (4) of the first housing part (1).

16. The pump of claim 1, characterized in that the fluid is a working gas which may be ambient air.

* * * * *